United States Patent [19]

Arbic et al.

[11] Patent Number: 4,676,536

[45] Date of Patent: Jun. 30, 1987

[54] DOOR BRACE

[75] Inventors: Harold J. Arbic; Philip F. Love; Donald Kramer, all of Detroit, Mich.

[73] Assignee: Door Guard, Inc., Detroit, Mich.

[21] Appl. No.: 926,597

[22] Filed: Nov. 3, 1986

Related U.S. Application Data

[63] Continuation of Ser. No. 534,929, Sep. 22, 1983, abandoned.

[51] Int. Cl.[4] ..... E05C 17/54

[52] U.S. Cl. ..... 292/339; 248/354.1; 248/354.5; 292/DIG. 15

[58] Field of Search ..... 292/338, 339, 263, DIG. 15; 254/39; 248/351, 354.1, 354.5; 70/94

[56] References Cited

U.S. PATENT DOCUMENTS

| | | | |
|---|---|---|---|
| 856,159 | 6/1907 | Keller | 248/351 X |
| 2,174,890 | 10/1939 | Lipiner | 292/263 X |
| 2,284,003 | 5/1942 | Luppert | 292/263 |
| 4,139,227 | 2/1979 | Spurr | 292/339 |
| 4,157,128 | 6/1979 | Peters | 292/339 X |

FOREIGN PATENT DOCUMENTS

| | | | |
|---|---|---|---|
| 1019016 | 11/1977 | Canada | 292/339 |

*Primary Examiner*—Robert L. Wolfe
*Assistant Examiner*—Lloyd A. Gall
*Attorney, Agent, or Firm*—Cullen, Sloman, Cantor, Grauer, Scott & Rutherford

[57] ABSTRACT

A door guard for wedging an entry door into a closed position thereby preventing unauthorized, forced opening of the entry door. The door guard includes a base plate which rests on the floor area behind an entry door. A lower brace member is pivotally attached at one end to the base plate. An upper brace member is pivotally attached to the lower brace member with the upper brace member including a plastic coated yoke member which is placed under and partially around the doorknob of an entry door. A spring is positioned to coact between the upper and lower brace members to bias the brace members into an aligned relationship. The overall length of the door guard can be adjusted by connecting the upper brace member to the lower brace member at different openings along the lower brace member. After the upper and lower brace members are brought into an aligned relationship, a rectangular buckle lock is positioned to lock the members together.

1 Claim, 4 Drawing Figures

DOOR BRACE

This is a continuation of application Ser. No. 534,929, filed Sept. 22, 1983, now abandoned.

BACKGROUND OF THE INVENTION

The present invention relates to a safety device for preventing forced entries into a home or the like, and more particularly, to a door guard which is positioned for wedging an entry door into a closed position thereby preventing a forced opening of the entry door.

Incidents of crime including breaking, entering, and burglary, are continuously increasing whereby individuals have become greatly concerned about personal safety and security for household belongings. Conventional door locks may be opened with simple tools, and other devices, such as door chain locks and the like, can be easily broken. Various electrical and electromechanical burglar detection and alarm devices are known for providing security to a home, but these more sophisticated devices are in many instances expensive, difficult to install, and subject to faulty operation. Thus, there has been a need for a safety device that provides an effective yet economical means to prevent breaking and entering or forced entry.

It is, therefore, an object of the present invention to provide a safety device for preventing the forced opening of an entry door, even if the door is unlocked. Another object of the present invention is to provide a safety device that is portable for use at any entry door and for use while traveling in hotels and the like. A further object of the invention is to provide a safety device that is inexpensive and easy to operate.

SUMMARY OF THE INVENTION

The door guard of the present invention prevents unauthorized home entry, even if the door lock is picked by a potential thief. It fits under a doorknob and extends to the floor for wedging the entry door shut in a locked position. The components of the door guard are hinged for portability and to permit initial placement of the door guard before it is snapped into a locked position against the entry door.

The door guard includes a base plate which rests on the floor area behind an entry door. The base plate includes a non-skid material undersurface to prevent sliding between the base plate and the floor on which it is placed. A lower brace member is pivotally attached at one end to the base plate, and it includes a pair of opposed generally parallel side walls interconnected by a third wall to form an open channel along its length. Each side wall includes a plurality of linearly spaced apart openings with the openings on one side wall being aligned with the openings on the other side wall. A handle is mounted at the outer free end of the lower brace member for operating and carrying the door guard.

An upper brace member is pivotally attached at one end to the lower brace member between a pair of the openings in the side walls of the lower brace member. A rubberized plastic coated yoke member is secured to one end of the upper brace member with the upper end of the yoke member being formed into a generally U-shaped crotch portion for fitting beneath and partially around a doorknob. The plastic coated yoke member includes generally rectangular and flat bearing surfaces on opposed sides of the U-shaped crotch portion for bearing against the door.

A spring is positioned to coact between the upper and lower brace members. The spring includes a coiled portion which lies along the pivotal axis between the upper and lower brace members. The spring also includes leg portions with one leg portion engaging the upper brace member and the other leg portion engaging the lower brace member. The coaction between the spring and the upper and lower brace members tends to bias the brace members into an aligned relationship.

The opposed aligned openings in the side walls of the lower brace member permit the upper brace member to be adjustably positioned at several locations along the lower brace member as desired. However, the openings are spaced a considerable distance from the outer free end of the lower brace member so that a substantial portion of the lower brace member always overlies a substantial portion of the upper brace member when the members are moved into an aligned relationship.

After the upper and lower brace members are brought into an aligned relationship, a rectangular buckle lock having an opening therein is positioned to lock the upper and lower brace members together. The buckle lock is slidably mounted on the upper brace member below the rubberized plastic coated yoke member. It is held upwardly out of the way until the lower and upper brace members becomes colinear. Then, the buckle lock is slid downwardly to lock the members together. The handle on the lower brace member prevents the buckle lock from sliding downwardly beyond a predetermined point.

The door guard of the present invention is used in the following manner. The upper and lower brace members are normally biased into an aligned relationship by the spring. This permits easier handling for transport and operation, less likelihood of injury because of the folding parts, and improved snap-over when locking the members in place. When it is desired to use the door guard, the upper end of the yoke member is aligned under the entry doorknob and the base plate is positioned on the floor area behind the entry door. In this position, the upper and lower brace members are partially folded against the resistance of the spring. The overall length of the door guard can be adjusted by connecting the upper brace member to the lower brace member at the different openings in the lower brace member.

When the door guard is properly positioned on the floor and under the doorknob, the operator applies downward pressure on the handle which is transmitted into an upward pressure on the upper brace member and a downward pressure on the lower brace member until the lower brace member snaps over the upper brace member into a locked position. In the locked position of the door guard, the longitudinal axes of the upper and lower brace members become colinear for assuring solid placement of the door guard between the doorknob and floor. The face-to-face engagement between the rectangular bearing surfaces on the plastic yoke member and the door also provides for effective force transfer from the door guard to the door. Finally, the buckle lock is slid into place for locking the upper and lower brace members together. The door guard is released by sliding the buckle lock upwardly out of the way and pulling on the handle thereby folding the upper and lower brace members and permitting removal of the door guard.

Other advantages and meritorious features of the door guard of the present invention will be more fully understood from the following description of the preferred embodiment, the appended claims and the drawings, a brief description of which follows.

DETAILED DESCRIPTION OF THE INVENTION

A preferred embodiment of the door guard of the present invention is illustrated in FIGS. 1-4.

Figures 1, 2:
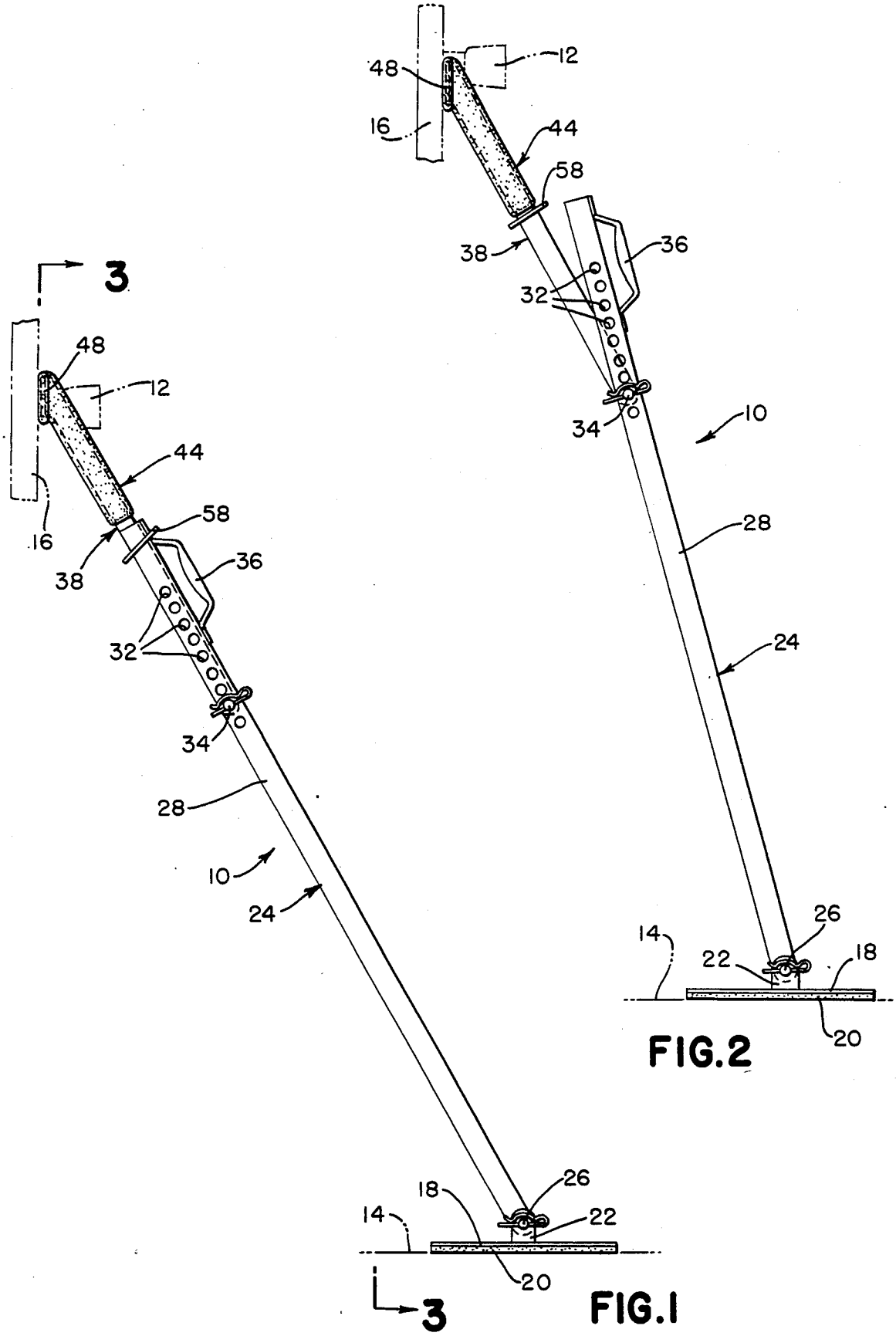
FIG. 1 is a side elevational view of the door guard of the present invention in its locked position between an entry door and floor area.
FIG. 2 is a side elevational view of the door guard with the upper and lower brace members partially folded for placement purposes.

As shown in FIG. 1, the door guard 10 fits under doorknob 12 and extends to floor 14 for wedging entry door 16 shut in a locked position, even if door 16 is unlocked.

Door guard 10 includes a base plate 18 which rests on floor 14 behind entry door 16. Base plate 18 includes a non-skid material undersurface 20 for preventing sliding between the base plate and floor on which it is placed. Various configurations may be used for base plate 18 including the rectangular shape illustrated. The top of base plate 18 includes a bracket 22 for mounting lower brace member 24. Lower brace member 24 is pivotally mounted at one end to base plate 18 by pin 26 which passes through bracket 22.

Lower brace member 24 includes a pair of opposed generally parallel side walls 28 interconnected by a wall 30 to form an open channel along the length of member 24. Each side wall 28 includes a plurality of linearly spaced apart openings 32 with the openings on one side wall being aligned with the openings on the other side wall to permit a pin 34 to pass therebetween. A handle 36 is mounted to wall 30 at the outer free end of brace member 24 for operating and carrying door guard 10.

An upper brace member 38 is pivotally attached at one end to lower brace member 24 by pin 34. Upper brace member 38 includes a pair of opposed side walls 40 interconnected by a wall 42 to form an open channel partially along the length of member 38. A rubberized plastic coated yoke member 44 is secured to one end of brace member 38. The upper end of yoke member 44 is formed with a generally U-shaped crotch portion 46 for fitting beneath and partially around doorknob 12. Plastic coated yoke member 44 includes generally rectangular and flat bearing surfaces 48 on opposed sides of the U-shaped notch portion 46 for bearing against door 16.

Figure 3:
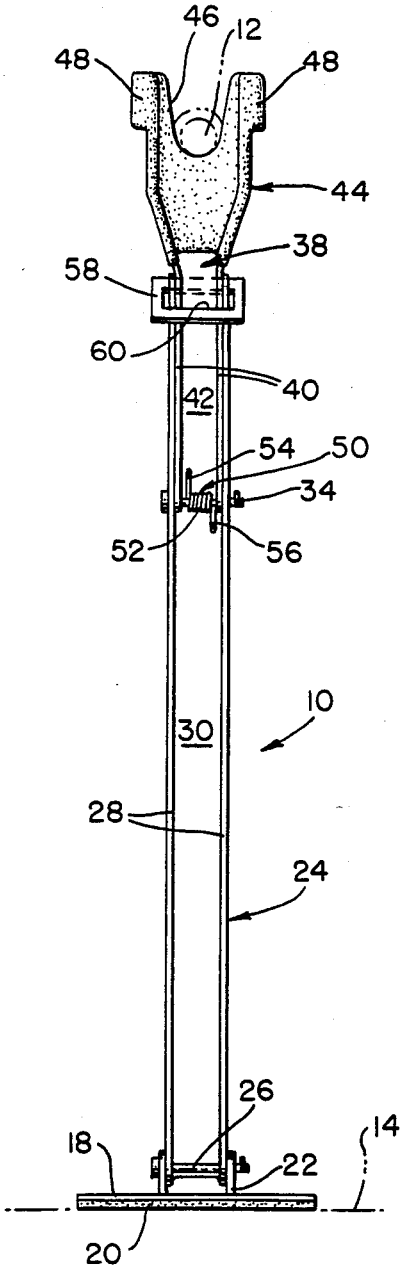
FIG. 3 is a front view of the door guard taken along line 3—3 in FIG. 1.
Figure 4:
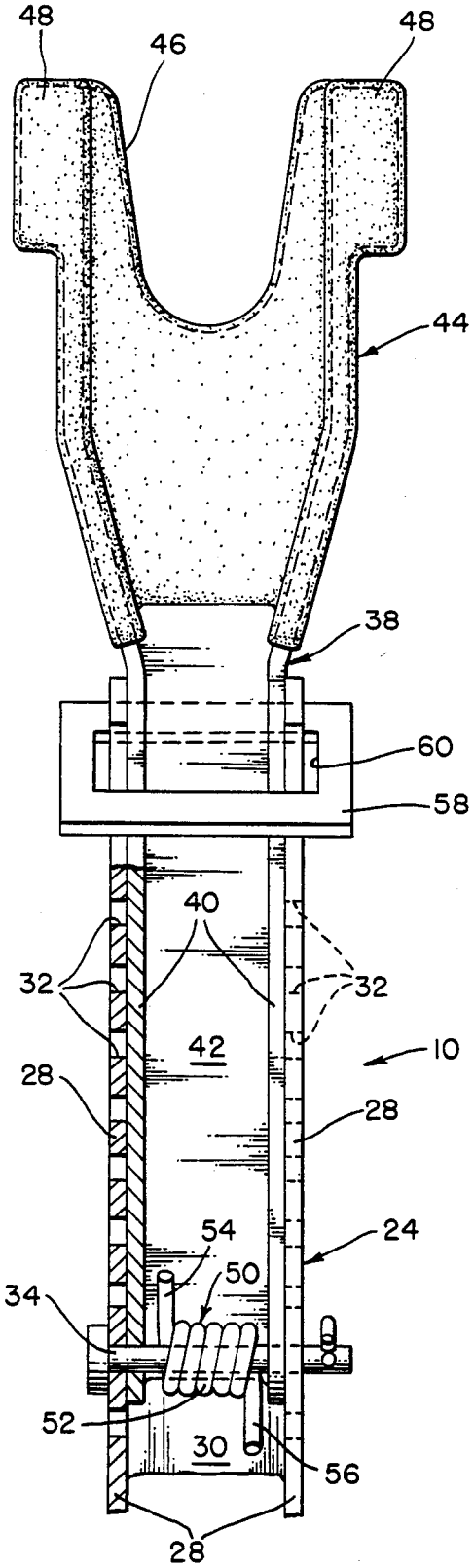
FIG. 4 is an enlarged front view of the upper part of the door guard partly in cross-section.

As illustrated in FIGS. 3 and 4, a spring 50 is positioned to coact between upper and lower brace members 24 and 38. Spring 50 includes a coiled portion 52 through which pin 34 is inserted when the upper and lower brace members are pivotally connected. Spring 50 also includes leg portions 54 and 56 with leg portion 54 engaging wall 42 of upper brace member 38 and leg portion 56 engaging wall 30 of lower brace member 24. Thus, coiled portion 52 lies along the pivotal axis between members 24 and 38 with leg portions 54 and 56 engaging members 24 and 38. This coaction between spring 50 and members 24 and 38 tends to bias members 24 and 38 into an aligned relationship as shown in FIGS. 1, 3 and 4.

The opposed aligned openings 32 in side walls 28 of lower brace member 24 permit the upper brace member 38 to be adjustably positioned at several locations along member 24 as desired. However, the openings 32 are spaced a considerable distance from the outer free end of member 24 so that a portion of the open channel formed by walls 28 and 30 always overlies a substantial portion of member 38 when members 24 and 38 are moved into an aligned relationship as shown in FIG. 1.

After members 24 and 38 are brought into an aligned relationship as shown in FIG. 1, a rectangular buckle lock 58 having an opening 60 is positioned to lock members 24 and 38 together. Referring to FIG. 2, buckle lock 58 is slidably mounted on member 38 below plastic yoke member 44. It is held upwardly out of the way until the lower and upper brace members 24 and 38 become colinear as shown in FIG. 1. Then, buckle lock 58 is slid downwardly to lock members 24 and 38 together. Handle 36 prevents buckle lock 58 from sliding downwardly beyond the position shown in FIG. 1.

The door guard 10 of the present invention is used in the following manner. Members 24 and 38 are normally biased into an aligned relationship by spring 50. This permits easier handling for transport and operation, less likelihood of injury because of the folding parts, and improved snap-over when locking members 24 and 38 are in place. When it is desired to use the door guard, the upper end of yoke member 44 is aligned under the entry doorknob 12 and base plate 18 is positioned on floor 14 as illustrated in FIG. 2. In this position, members 24 and 38 are partially folded against the resistance of spring 50. The overall length of the door guard can be adjusted by connecting member 38 to member 24 at different openings 32 along member 24.

When the door guard is properly positioned on floor 14 and under doorknob 12, the operator applies downward pressure on handle 36 which is transmitted into upward pressure on member 38 and downward pressure on member 24 until member 24 snaps over member 38 in a locked position. When door guard 10 is in its locked position, the longitudinal axes of members 24 and 38 become colinear for assuring solid placement of door guard 10 between doorknob 12 and floor 14. The face-to-face engagement between rectangular bearing surfaces 48 and door 16 also provides for effective force transfer from the door guard to the door. Finally, buckle lock 58 is slid into place as shown in FIGS. 1, 3 and 4 for locking members 24 and 38 together. Door guard 10 is released by sliding buckle lock 58 upwardly to a position such as shown in FIG. 2 and pulling on handle 36 thereby folding members 24 and 38 and permitting removal of door guard 10.

As described, door guard 10 may be placed in position behind any entry door having a doorknob for preventing the forced opening of the entry door, even if it is unlocked. Any pressure exerted against the door causes the base plate 18 to grip tighter to the floor surface 14. Thus, door guard 10 provides an effective and economical means of preventing burglary by breaking and entering. Since it is portable, door guard 10 may be used at any entry door and also in hotel and motel rooms while traveling.

It will be apparent to those skilled in the art that the foregoing disclosure is exemplary in nature rather than limiting, the invention being limited only by the appended claims.

We claim:

1. A door guard for preventing forced opening of an entry door, said door guard including:

a base member having non-skid material on one of its surfaces to prevent sliding;

a lower brace member pivotally attached at one end to said base member, said lower brace member including a pair of opposed generally parallel side walls interconnected by a third wall to form an open channel, each side wall including a plurality of linearly spaced apart openings with the openings on one side wall being aligned with the openings on the other side wall, a handle mounted to said third wall at an outer free end of said lower brace member for operating and carrying said door guard;

an upper brace member pivotally connected at one end to said lower brace member between a selected pair of said openings in said side walls, a plastic coated yoke member secured to one end of said upper brace member, said plastic coated yoke member having an upper end formed as a generally U-shaped crotch portion for fitting beneath and partially around a door knob on said entry door, and said yoke member including generally flat, laterally extending bearing surfaces on opposed sides of said crotch portion for bearing against said entry door;

said upper brace member having opposed side walls interconnected by a third wall, each of said upper brace side walls having an opening with the opening in one side wall being aligned with the opening in the opposite side wall, said openings further being selectively alignable with a pair of openings in said lower brace member;

a pin receivable by said aligned openings in said lower and upper brace members to permit said lower member to be pivoted about said pin and snapped-down over said upper member such that the longitudinal axes of said upper and lower members are in an aligned colinear relationship, said lower member overlapping a substantial segment of said upper member adjacent said pin;

said overlapped segments of said upper and lower members distributing the torsional forces exerted at said pin along the length of said segments such that there is no concentration of forces at a single point, a spring including a coiled portion which lies along the pin between said upper and lower brace members, said spring also including free leg portions with one leg portion engaging the third wall of said upper brace member and another leg portion engaging the third wall of said lower brace member, the axes of said leg portions being perpendicular to the axis of said coiled portion, and said spring coacting with said brace members for normally biasing said brace members into an aligned relationship;

said openings in said side walls of said lower brace member being spaced a considerable distance from the outer free end of said lower brace member so that a substantial portion of said lower brace member always overlies a substantial portion of said upper brace member when said brace members are moved into an aligned relationship distributing the forces exerted on said door guard along the length of said overlying sections such that there is no concentration of forces at any point; and said door guard being positioned between a horizontal surface and said door knob on said entry door with said upper and lower brace members being partially folded against the resistance of said spring, and said lower brace member being movable into a snapped-down position by applying pressure to said handle for overlying a part of said upper brace member thereby bringing the longitudinal axes of the upper and lower brace members into aligned colinear relationship and wedging said entry door into a closed position for preventing forced opening of said entry door.

* * * * *